US006733726B2

(12) United States Patent
O'Connor

(10) Patent No.: US 6,733,726 B2
(45) Date of Patent: May 11, 2004

(54) HIGH CORROSION RESISTANCE ALUMINUM ALLOY

(75) Inventor: Kurt F. O'Connor, Carmel, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/215,205

(22) Filed: Aug. 8, 2002

(65) Prior Publication Data

US 2003/0017072 A1 Jan. 23, 2003

Related U.S. Application Data

(63) Continuation-in-part of application No. 09/777,269, filed on Feb. 15, 2001, now abandoned.

(51) Int. Cl.[7] ..... C22C 21/02
(52) U.S. Cl. ..... 420/548; 420/549; 420/550
(58) Field of Search ..... 420/548, 549, 420/550, 553

(56) References Cited

U.S. PATENT DOCUMENTS 6,376,375 B1 4/2002 Hewitt-Bell et al.
6,586,110 B1 7/2003 Obeshaw

OTHER PUBLICATIONS

"ASM Specialty Handbook: Aluminum and Aluminum Alloys", ASM International, 1993, pp. 93,624–625,726–727.*

Cayless, R.B.C; Akcan Rolled Products Company; "Alloy and Temper Designation Systems for Aluminum and Aluminum Alloys;" Metals Handbook®, Tenth Edition, vol. 2, (1990); pp. 15–28.

"RegistrationRecord of Aluminum Association Alloy Designations and Chemical Composition Limits for Aluminum Alloys in the Form of Castings and Ingot," The Aluminum Association, Inc., (1989), pp. 2–11.

* cited by examiner

*Primary Examiner*—Roy King
*Assistant Examiner*—Janelle Combs Morillo
(74) *Attorney, Agent, or Firm*—Jimmy Funke; Stefan V. Chmielewski

(57) ABSTRACT

An aluminum-based die casting alloy exhibiting improved corrosion resistance and good die-castability contains from about 4.5 to about 12 percent silicon by weight, at least 87 percent aluminum by weight, from about 0.25 percent to about 0.6 percent manganese by weight, and a maximum of 0.2 percent copper by weight. The alloys preferably contain iron in an amount sufficient to improve hot tear resistance and to decrease the tendency for die sticking or soldering during die casting.

10 Claims, No Drawings

HIGH CORROSION RESISTANCE ALUMINUM ALLOY

CROSS REFERENCE TO RELATED APPLICATIONS

This Application is a continuation-in-part of U.S. patent application Ser. No. 09/777,769, filed on Feb. 5, 2001 now abandoned, entitled "HIGH CORROSION RESISTANCE ALUMINUM ALLOY."

TECHNICAL FIELD

This invention relates to aluminum alloys, and more particularly to aluminum casting alloys, especially those used for pressure-die casting.

BACKGROUND OF THE INVENTION

The total weight of die cast aluminum products exceeds the total weight of aluminum alloy castings prepared by all other casting techniques combined. Further, aluminum alloys are used more frequently in die castings than any other base metal. The extensive use of aluminum die-cast alloys for various articles such as machine parts, housings for machines, electronics, instruments, etc. is attributable at least in part to the high dimensional accuracy and smooth and attractive casting surfaces of aluminum die-cast alloys in the as-cast condition.

While many of the known aluminum castings alloys exhibit acceptable corrosion resistance for moderately harsh environments, the known aluminum casting alloys, and in particular the known aluminum die casting alloys, are not sufficiently resistant to corrosion for certain highly corrosive environments. For example, aluminum castings that are used in highly corrosive exterior automotive applications in which the castings are routinely exposed to temperature extremes, water, snow, ice and humidity, as well as corrosion inducing materials such as salt, and dirt and road grime that can retain moisture and salt, eventually tend to exhibit significant corrosion. The known aluminum die casting alloys generally contain silicon in an amount that is effective to improve fluidity of the alloy in a molten state during the die casting operation. Additions of silicon also improve hot tear resistance and have beneficial effect on tensile strength and elongation properties of cast compounds. The most commonly used aluminum-silicon alloy for die casting is alloy 380.0 and its modifications. The 380.0 family of alloys exhibit a balanced combination of low cost, strength, and corrosion resistance, as well as high fluidity and freedom from hot shortness that are required to achieve good die-castability. However, the 380.0 alloys and other aluminum die casting alloys typically contain copper in an amount of from about 2 to about 4.5 percent. Copper is added to improve strength and hardness, but generally reduces resistance to general corrosion. Thus, the 380.0 family of aluminum alloys does not exhibit high corrosion resistance, and is unsuitable for certain automotive applications, such as for exposed parts that are mounted in the engine compartment of a vehicle.

Where better corrosion resistant is required, alloys low in copper, such as 360.0 and 413.0 are typically used. These alloys still contain a significant amount of copper (0.6 and 1.0 percent by weight, respectively) and consequently show clearly visible signs of corrosion when exposed to a highly corrosive environment for a prolonged period. Thus, the known aluminum die casting alloys are not especially well suited for those applications in which it is desired to use a die cast aluminum component which maintains a good, non-corroded appearance after prolonged exposure to a highly corrosive environment.

Attempts to further improve corrosion resistance by lowering the copper content below 0.6 percent would be expected to result in unsatisfactory strength properties for most applications. Therefore, it would be highly desirable to have an aluminum die casting alloy that is highly resistant to corrosion yet exhibits adequate strength for use in making automotive components that are mounted in the engine compartment of a vehicle, and components for outdoor use such as light fixtures, electronic housings, telephone cases, etc.

SUMMARY OF THE INVENTION

This invention is directed to an aluminum alloy having improved corrosion resistance and excellent strength characteristics. The aluminum alloys of this invention are characterized by a very low copper content, a manganese content that is sufficient to input excellent strength properties, and a silicon content that is sufficient to impart excellent fluidity, hot tear resistance and feeding characteristics for good die-castability.

These and other features, advantages and objects of the present invention will be further understood and appreciated by those skilled in the art by reference to the following specification and claims.

DESCRIPTION OF THE PREFERRED EMBODIMENTS

In accordance with the principles of this invention, an aluminum die casting alloy having improved corrosion resistance and excellent die-castability properties has a relatively low copper content that is effective to achieve enhanced corrosion resistance, in conjunction with a relatively high silicon content that is effective to impart good die-castability, while exhibiting excellent strength for various automotive and other exterior/outdoor applications.

The aluminum alloys of this invention typically have a silicon content of from about 4.5 percent by weight to about 12 percent by weight to impart suitable fluidity, hot tear resistance, wear resistance and feeding characteristics. More desirably, the silicon content is from about 8 percent by weight to about 12 percent by weight, with optimum die-castability properties for the highly corrosion resistant alloys of this invention being achieved in a range of from about 9.5 to about 12 percent silicon by weight.

Conventional aluminum casting alloys typically contain relatively high amounts of copper in order to improve the machinability, strength and hardness of the casting. However, copper reduces resistance to general corrosion, and, therefore, is present in the aluminum alloys of this invention in relatively low amounts, if at all. In order to achieve excellent corrosion resistance, the aluminum alloys of this invention typically contain 0.08 percent copper by weight or less, and more preferably 0.05 percent or less.

Iron is preferably added to the aluminum die casting alloys of this invention to improve hot tear resistance, and decrease the tendency for die sticking or soldering during die casting. A suitable amount of iron is from about 0.8 percent to about 2.0 percent by weight, with an amount of from about 0.8 to about 1.3 percent by weight being preferred, and an amount of 0.8 to about 1.0 percent by weight being most preferred.

Most aluminum casting alloys, and especially aluminum die casting alloys, have an aluminum content of about 86 percent by weight or less. For example, the most commonly used aluminum die casting alloy (alloy 380.0) contains from about 79 to about 83 percent aluminum by weight. The conventional corrosion resistant aluminum die casting alloys, alloys 360.0 and 413.0, contain from about 85 to about 86.5 percent aluminum by weight and from about 82 percent to about 84 percent aluminum by weight, respectively. In contrast, the aluminum die casting alloys of this invention have a relatively high aluminum content, and as a result, exhibit a thermal conductivity that is about 20 percent greater than that of alloy 380.0. Further, the alloys of this invention can be processed through liquid hot isostatic pressing to achieve a thermoconductivity that is about 40 percent greater than that of the 380.0 alloy. The alloys of this invention typically contain at least 87 percent, more preferably at least 88 percent, and most preferably at least 89 percent aluminum by weight.

Manganese is present in an amount from about 0.25 to about 0.6 percent by weight to enhance strength, and more preferably from about 0.35 to about 0.45, with about 0.40 percent manganese being most preferred. These levels of manganese have been found to compensate, at least in part, for the relatively low levels of Cu, to enhance strength properties without significantly adversely affecting corrosion resistance, die-castability or other relevant properties.

Magnesium, nickel, zinc and tin may be present in the alloy in relatively minor amounts, preferably about 1.5 percent or less, more preferably about 1 percent or less, and even more preferably about 0.5 percent or less.

Other elements are not desirable, and are preferably present in an amount of less than 0.5 percent by weight, and more preferably less than 0.25 percent by weight.

Test coupons made of an alloy according to this invention were compared with similar coupons prepared from conventional corrosion resistant aluminum die-cast alloys (alloy 360.0) under rigorous salt spray conditions. The salt spray conditions induce accelerated corrosion. Under such conditions, the coupons cast from the alloys of this invention exhibited a noticeable improvement in corrosion resistance and maintained an improved appearance for a longer period of time than the coupons cast from the conventional alloy.

Although the corrosion resistant aluminum alloys of this invention are expected to be used primarily for die casting corrosion resistant components, the alloys are also suitable for use in semi-solid molding processes and semi-solid forging processes. Die-casting, semi-solid molding, and semi-solid forging operations are all well known in the industry and, therefore, are not described herein.

It has also been discovered that the aluminum alloys of this invention exhibit improved elongation as compared with alloy 380.0 and other highly corrosion resistant alloys. This, for example, allows higher torque levels on bolts or screws threaded into dies cast articles before die cast threaded bores in the article become stripped.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

What is claimed is:

1. An aluminum-based alloy comprising:

at least about 87 percent aluminum by weight;

from about 4.5 percent to about 12 percent silicon by weight;

from about 0.25 percent to about 0.6 percent manganese by weight;

a maximum of about 0.08 percent copper by weight; and from about 0.8 percent to about 2.0 percent iron by weight.

2. The alloy of claim 1, wherein the iron is present in an amount of from about 0.8 to about 1.3 percent by weight.

3. The alloy of claim 1, wherein the iron is present in an amount of from about 0.8 percent to about 1.0 percent by weight.

4. The alloy of claim 1, having a maximum of 0.05 percent copper by weight.

5. The alloy of claim 1, containing silicon in an amount of from about 8 percent to about 12 percent by weight.

6. The alloy of claim 1, containing silicon in an amount of from about 9.5 percent to about 12 percent by weight.

7. The alloy of claim 1, wherein the aluminum is present in the alloy in an amount of at least 88 percent by weight.

8. The alloy of claim 1, wherein the aluminum is present in the alloy in an amount of at least 89 percent by weight.

9. The alloy of claim 1, wherein the manganese is present in an amount of from about 0.35 percent to about 0.45 percent by weight.

10. An article of manufacture made from an aluminum alloy comprising:

at least about 87 percent aluminum by weight;

from about 4.5 percent to about 12 percent silicon by weight;

from about 0.25 percent to about 0.6 percent manganese by weight;

a maximum of about 0.08 percent copper by weight; and from about 0.8 percent to about 2.0 percent iron by weight.

* * * * *